US007505722B2

(12) United States Patent
Condello et al.

(10) Patent No.: US 7,505,722 B2
(45) Date of Patent: Mar. 17, 2009

(54) CONVECTIVE HOT AIR IMPINGEMENT DEVICE WITH LOCALIZED RETURN PATHS

(75) Inventors: Anthony S. Condello, Webster, NY (US); Elias Panides, Whitestone, NY (US); Augusto E. Barton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 142 days.

(21) Appl. No.: 11/704,651

(22) Filed: Feb. 8, 2007

(65) Prior Publication Data

US 2008/0193174 A1 Aug. 14, 2008

(51) Int. Cl.
*G03G 15/20* (2006.01)

(52) U.S. Cl. ..... 399/320; 219/216; 399/92; 399/335

(58) Field of Classification Search ..... 399/320, 399/341, 328, 329, 335, 92; 347/156; 219/216
See application file for complete search history.

(56) References Cited

U.S. PATENT DOCUMENTS 5,086,209 A * 2/1992 Kintz et al. ..... 219/216
5,784,679 A * 7/1998 Schlueter et al. ..... 399/335
6,754,457 B2 6/2004 Ciaschi et al.

* cited by examiner

*Primary Examiner*—Sophia S Chen
(74) *Attorney, Agent, or Firm*—James J. Ralabate

(57) ABSTRACT

This is a pre-heater system especially useful in an electrostatic marking apparatus. It is used to heat the toner and paper (media) prior to the paper entering the conventional fuser station. Using this pre-heater increases fusing productivity (ppm), widens media latitude and/or extends fuser member life for a given fuser system. It also dramatically improves uniform heat transfer and paper handling problems encountered in prior art preheat fusing assemblies. The preheater is used together with the conventional fuser stations used today in electrostatic marking systems.

17 Claims, 3 Drawing Sheets

CONVECTIVE HOT AIR IMPINGEMENT DEVICE WITH LOCALIZED RETURN PATHS

This invention relates to electrostatic printing systems and, more specifically, to the fusing assembly and a pre-heater for said assembly.

BACKGROUND

Generally, in a commercial electrostatographic reproduction apparatus (such as copier/duplicators, printers, or the like), a latent image charge pattern is formed on a uniformly charged photoconductive or dielectric member. Pigmented marking particles (toner) are attracted to the latent image charge pattern to develop such image on the dielectric member. A receiver member, such as paper, is then brought into contact with the dielectric member and an electric field applied to transfer the marking particle developed image to the receiver member from the dielectric member. After transfer, the receiver member bearing the transferred image is transported away from the dielectric member and the image is fixed or fused to the receiver member by heat and/or pressure to form a permanent reproduction thereon.

Sometimes copies made in Xerographic or electrostatic imaging systems have defects caused by improper fusing of the marking material or toner to the receiving media such as paper. There can be many possible causes of these defects including toner contaminants, charging problems or incomplete fusing. In these systems, the image is fixed to the receiving member by heat and pressure to form a permanent reproduction thereon.

Typical electrographic reproduction apparatus includes at least one heated roller having an aluminum core and an elastomeric cover layer, and at least one pressure roller in nip relation with the heated roller. The fusing device rollers are rotated to transport a receiver member bearing a marking particle image, through the nip between the rollers. The toner or pigmented marking particles of the transferred image on the surface of the receiver member soften and become tacky in the heat. Under the pressure, the softened tacking marking particles attach to each other and are partially imbibed into the interstices of the fibers at the surface of the receiver member. Accordingly, upon cooling, the marking particle image is permanently fixed to the receiver member.

In some instances, low melting point marking particles or toner are subject to increase image offset to the heating roller. This can produce streaks and undesirable defects in the final copy. This image offset can be reduced by application of fusing oil to the heating roller. The use of such oil introduces further complications into the fusing system, such as handling of the oil and making sure that the layer of oil on the roller is uniform. Alternatively, a mechanical arrangement for reducing image offset, without the need for fusing oil has been found. Such mechanical arrangement provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing, but is not particularly suitable for black image fusing. There is a need for a convenient and effective way to improve the fusing operations in Xerographic systems.

An option that does not involve core fuser redesign is the preheat concept. By heating the media or paper and toner prior to entering the conventional fusing nip, it is possible to increase productivity for a given fusing system, or if desired, trading speed benefits for lower temperature and/or wider media latitude at current throughputs. After considerable study, it was decided to pursue hot air impingement as the preferable means of preheating . Radiant heating was eliminated due to the risk of fire. Conduction was not used since touching unfused prints typically lead to image defects. Convective heating is much safer than radiant and much more "image-friendly" than conduction. This invention introduces a design concept that directly addresses the fundamental issues of heat transfer efficiency, uniformity and paper handling.

SUMMARY

Higher productivity, increased reliability and lower run costs are goals inherent to most electrostatic marking programs. Fusing systems many times hit technology "breakpoints" limiting their extensibility for use in follow-on products. The ability to heat the toner and media immediately prior to entering the fuser has proven to extend a fuser's usability as a function of speed, media latitude and/or life.

This invention outlines a convective (forced hot air impingement) device used to raise the incoming sheet temperature and effectively share the fusing function with the conventional fuser.

A unique aspect of embodiments of this concept is the use of localized return paths (straws or tubes) which dramatically improve heat transfer and paper handling problems that have inhibited the functionality of previous "perimeter/skirt-return" designs.

This invention outlines the benefits and potential embodiments of a hot air impingement device with localized return paths to augment effective/uniform heat transfer and also promote stable media transport. Two primary issues with prior art such as the U.S. Pat. No. 6,754,457 system current convective preheat hardware are:

1) non-uniform h (convective heat transfer coefficients) across the impingement zone; This is at least partially caused by the reduction in direct impingement as a result of bulk air flow obstructing the direct flow from jets other than near the center of the plenum (See FIG. 4 of drawings). Non-uniform impingement equates to non-uniform heat transfer. FIG. 4 of the drawings demonstrates how the bulk air flow (impinged air heading toward the skirt) of the skirt-return design negatively affects the h uniformity. While the drawings illustrate the consistent h pattern that can be expected, regardless of position inboard/outboard or cross process, when using the proposed localized return path geometry. FIGS. 3 and 4 are side views comparing the simplified air flow patterns of the two designs, i.e. present and prior art. 2) The "sucking-up" of paper into the perimeter return paths (element 20 in FIG. 4) resulting in paper jams or image disturbance. In order to increase h for a given geometry it is required to increase the air flow. However, increasing air flow in a skirt-return system augments the dysfunction of paper sucking-up.

Proposed is a plenum design that both maintains hold specification critical to effective impingement (pattern, diam, etc.) and incorporates low area vacuum return paths. The plenum geometry (although not optimized) has been designed using empirically supported numerical modeling. The FIG. 3 description lists plenum dimensions that were identified in one embodiment to nominally meet known preheat criteria such as h at the sheet and vacuum pressure.

The models tested have predicted average h values comparable to those maximum values generated using existing "open-plenum/skirt return" hardware. The air return path (vacuum area presently represents −20 mm of the process direction length under the plenum (10 mm skirt at entrance and exit.) This ID proposes that the vacuum spread across the entire plenum area via small, evenly spaced holes. Uniformly spreading out of the return flow greatly reduces the risk of the sheet lifting off of the transport. The design reduces the maximum pulling force on the sheet by more than 10×.

The returned air is drawn through the impingement chamber via an array of tubes or straws. The straws open to an upper chamber where the bulk air is then fed back into the blowers, directed through heaters and finally to the impingement plenum. This ideally closed system minimizes energy losses. Hardware has been designed and fabricated for empirical testing.

In U.S. Pat. No. 6,754,457 (Ciaschi) a pre-heater assembly is disclosed. In the present invention the use of impingement holes or apertures have proven through numerical and empirical modeling to be a much more efficient way to convectively transfer heat (for the same flow rate). This fact has been well documented in numerous occasions. With apertures or holes the impingement flow is more localized which is why much higher h's (convective heat transfer coefficients) are observed. This is a fundamental performance advantage over the prior art including Ciaschi's system. The combination of holes or apertures and localized tube air return paths are a more efficient transfer of heat to the media then slots with localized return paths of the prior art. Considering the entire area within the heating zone, the apertures or holes of the present invention will transfer heat more uniformly. In the present invention, hundreds of holes may be closely spaced across the entire area where as only a small number of slits are described in prior art systems.

By "conventional fuser station" is meant throughout this disclosure and claims, any of the fuser stations used in Xerox and other electrostatic copiers or duplicators or printers used today.

DETAILED DISCUSSION OF DRAWINGS AND PREFERRED EMBODIMENTS

Figure 1:
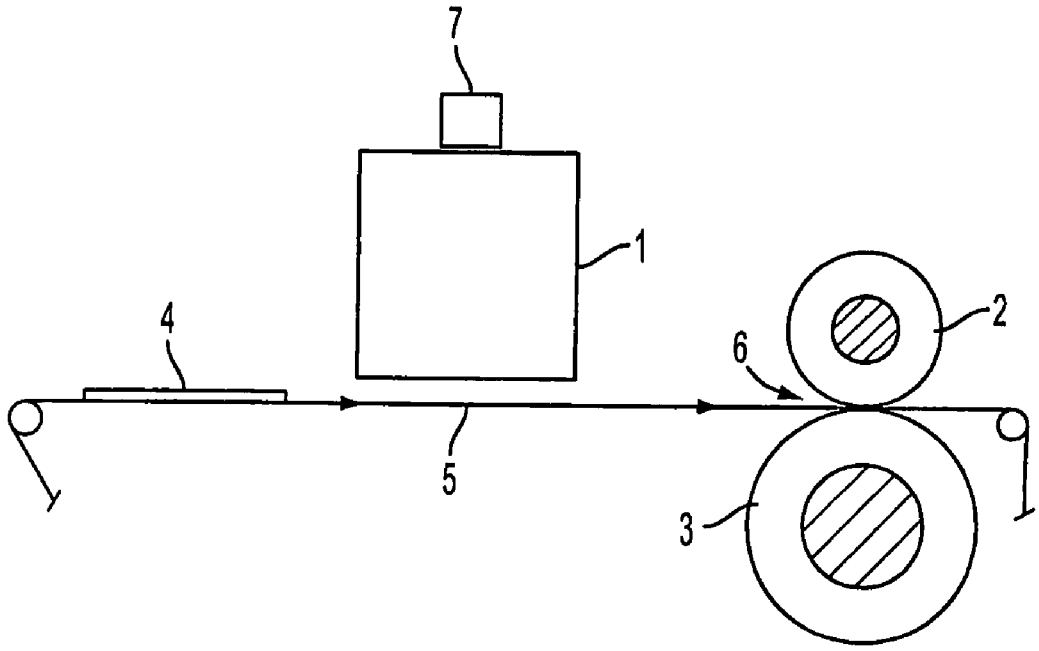
FIG. 1 is a side view of an electrophotographic fusing station with a pre-heater unit positioned before the fuser assembly.

In FIG. 1, the pre-heater unit 1 is shown at a position in the travel path in an electrophotographic marking system where it is always located before the fuser roll 2 and pressure roll 3. The pre-heater 1 provides for impingement of heater air onto a receiving member 4 having unfused marking particles thereon. The pre-heater 1 enhances the quality and speed of fusing a toner or marking material to receiving member 4. The fusing assembly made up of a fuser roll 2 and a pressure roll 3 provides the final fusing of the toner to the paper 4. Generally, a conventional fuser roll 2 is used usually having an elastomeric outer layer on a heat conductive roll usually made from aluminum. A heater is provided for the fuser roll either internally or externally. The receiving member, after passing under the pre-heater 1, is transported by a belt 5 (or a drum) to a fusing nip 6 between the fuser roll 2 and pressure roll 3 for optimum fusing efficiency. The pre-heater 1 of this invention provides for pre-heating paper 4 by passing a continuous uniform flow of hot air on the image-bearing surface of paper 4. Details of pre-heater 1 are set out in the description of FIG. 2. Appropriate sensors may be used along the paper path to provide information and conditions for high efficiency fusing. A blower fan 7 to force heated air through the pre-heater unit 1 is provided.

Figure 2:
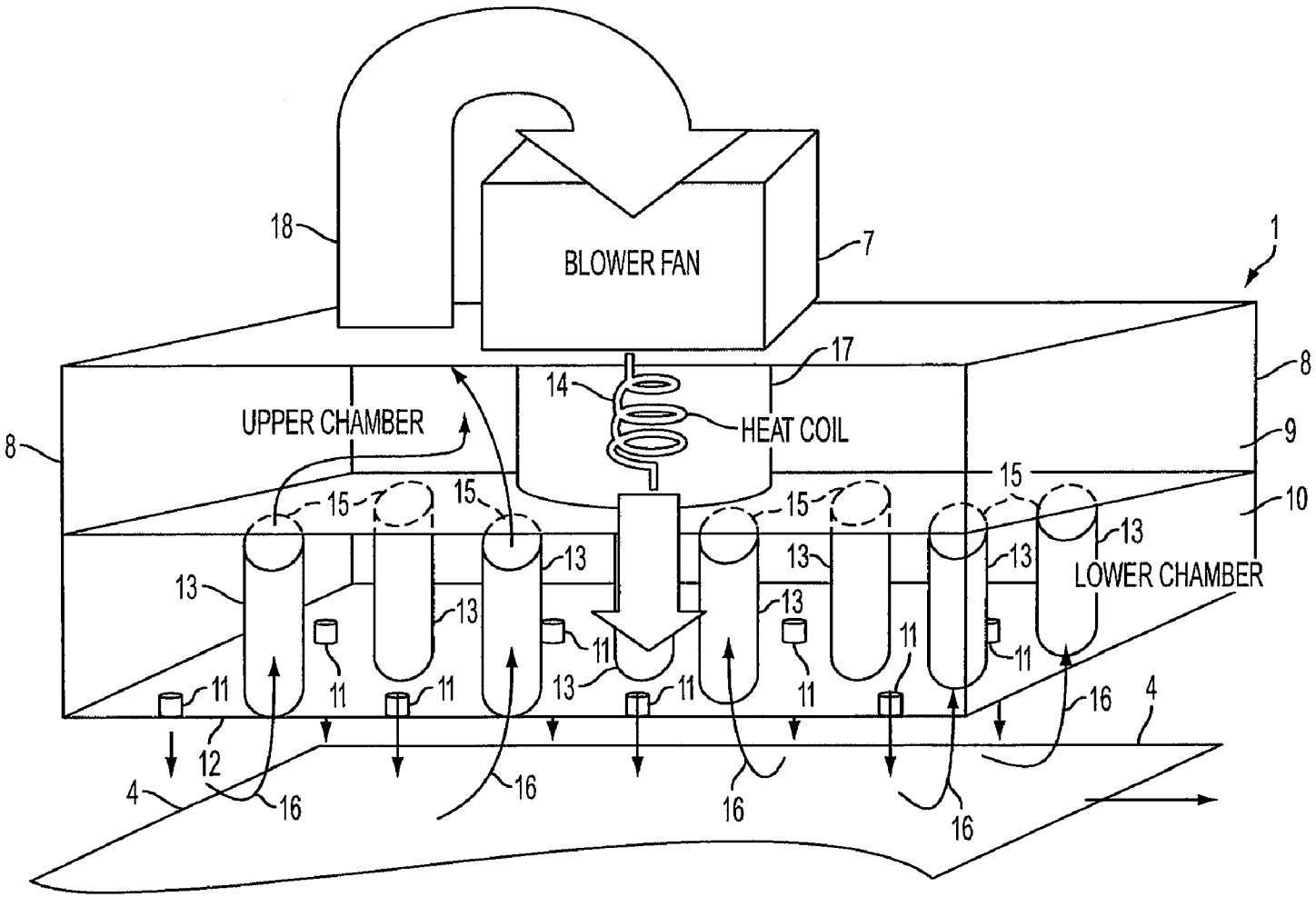
FIG. 2 is a side perspective view of an embodiment of the pre-heater system of this invention.

In FIG. 2, an embodiment of the present pre-heater 1 invention is illustrated. The pre-heater 1 comprises a substantially airtight housing 8 having in an operational arrangement, an upper chamber 9 and a lower chamber 10. These two chambers 9 and 10 are co-extensive. A plurality of hot air impingement apertures or holes 11 are located in a bottom section 12 of said lower chamber 10. A plurality of open ended return vacuum tubes 13 extend from the upper chamber 9 through the lower chamber 10 and even with or beyond the lower face of bottom section 12 of the lower chamber 10. A heater coil 14 is adapted to heat the air and have it circulated by a fan or blower 7. The air is blown into the lower chamber 10 and through the impinging apertures 11 to uniformly heat the receiving member or paper 4 as it travels under the pre-heating unit 1 toward a "conventional" fusing station comprising a fuser roll 2 and a pressure roll 3. The return vacuum tubes 13 are enabled to continuously recycle the heated air to the upper chamber 9 and to the fan blower 7. The use of impingement holes or apertures 11 have proven to be a much more efficient way to convectively transfer heat (for the same flow rate). This is because with a plurality of holes 11 the impingement flow is more localized which is why much higher h's (convective heat transfer coefficients) are observed. This is one very fundamental advantage over the prior art pre-heaters. The combination of apertures 11 and localized return paths via tubes 13 are considered to much more efficiently transfer heat to the receiving media or paper 4 than prior art slots with localized return paths. Considering the entire area within the heating zone, the apertures 11 transfer heat more uniformly. In the present invention, hundreds of apertures 11 are closely spaced across the entire area whereas only a small number of slits are used in the prior art.

The return tubes 13 in an embodiment have a diameter of from 2-10 times the diameter of apertures 11. Of course, these diameters will vary depending upon the size of the pre-heater 1 and other variables. In one embodiment tested, a vacuum tube 13 diameter of 3 mm was used with apertures 11 having a diameter of about 1 mm. Openings 15 are provided in a lower section of upper chamber 9 and facilitates the return passage of heated air from the paper 4 surface to the blower fan 7 for recirculation to the lower chamber 10 and through apertures 11. These return tubes 13 provide the sole air return to the upper chamber 9 and blower fan 7. The arrows 16 indicate the flow of heated air during use of the pre-heater 1. A hot air conduit 17 provides for passage of pressurized heated air from the blower fan 7 to the lower chamber 10. Thus, there is hot air impingement onto paper 4 from lower chamber 10 (via apertures 11) which is pressurized by blower fan 7 to the paper. Then the return heated air flows into upper chamber 9 and back to blow inlet 18. The process sequence is: (1) air is blown across heater coil 14 and into lower chamber 10; (2) pressurized air is forced out holes 11; (3) air heats paper 4; (4) air is returned through vacuum cylinders 13; and (5) return air is collected in upper chamber 9 and fed back into blower inlet 7.

Figure 3:
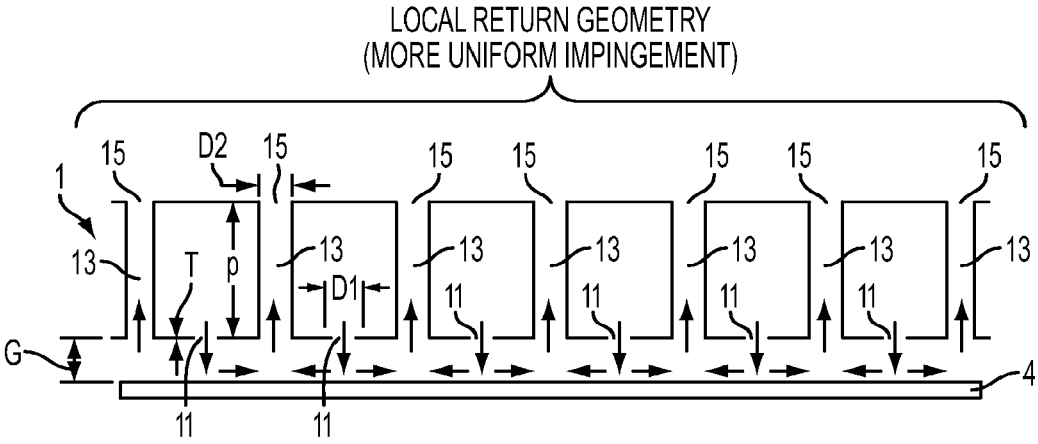
FIG. 3 is a side view of an embodiment of the pre-heater system of this invention showing the air circulation during use.

In FIG. 3, a side view of pre-heater 1 shows the heated air circulation throughout substantially airtight housing 8. The air passes from lower chamber 10 through apertures 11 to the image surface of paper 4. Once the heated air contacts paper 4, it is recirculated through vacuum tubes 13 via openings 15 to upper chamber 9 and to the blower inlet 18 (see FIG. 2). The arrows 16 show the paths of the heated air in the pre-heater 1. Note that there is much more uniformity of heat contact on paper 4 than the prior art systems of FIG. 4. An embodiment with typical illustrative (not limiting) parameters and measurements would be as follows: p=plenum height=25.4 mm; T=plate thickness=1.5 mm; D1=hole diameter in=1 mm; D2=hole diameter out=3 mm and G=gap (to paper)=10 mm.

Figure 4:
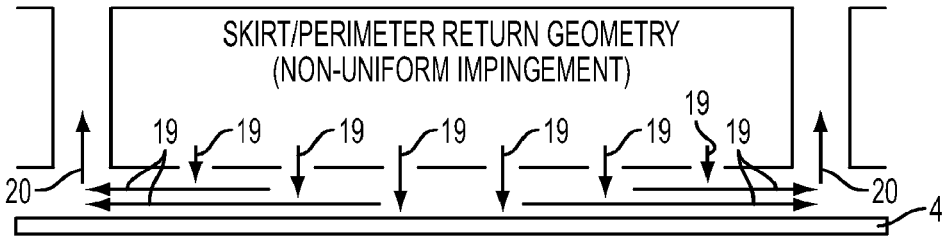
FIG. 4 PRIOR ART
FIG. 4 is a side view of a prior art pre-heater unit showing the air circulation during use.

In FIG. 4, a prior art air flow having non-uniform air impingement is shown. Note that arrows 19 clearly show the non-uniformity of heated air contact with paper 4. Also, end perimeter returns 20 of the prior art have caused paper 4 end or edge bending because of the high pressure at returns 20. This paper edge deforming frequently causes paper jams and other paper transport problems.

While particular embodiments have been described, alternatives, modifications, variations, improvements, and substantial equivalents that are, or, may be presently unforeseen, may arise to applicants or others skilled in the art. Accordingly, the appended claims as filed and as they may be amended are intended to embrace all such alternatives, modifications, variations, improvements and substantial equivalents.

What is claimed is:

1. A pre-heater system for a fusing assembly used in an electrostatic marking apparatus comprising in an operative arrangement a heater housing, an upper chamber, a lower chamber, open-ended return vacuum air tubes, hot air impingement air apertures, and at least one heater with a blower fan, said fan enabled to blow air across said heater and into said lower chamber, whereby pressurized heated air is thereby forced out of said apertures onto paper (or receiving media) that is adjacent said impingement apertures, and said vacuum air tubes extending from below said heater housing to said upper chamber and enabled to return said heated air to said upper chamber where it is fed back into said blower fan.

2. The system of claim 1 wherein said heated air is continuously fed through said impingement apertures, contacts said paper, and is returned to said blower fan via said return vacuum tubes.

3. The system of claim 1 wherein said pre-heater system is located in an electrostatic marking apparatus at a position before said fusing assembly.

4. The system of claim 1 wherein said return vacuum air tubes have a diameter at least two times the diameter of said apertures.

5. The system of claim 1 wherein said pre-heater system is enabled to increase a fusing speed of an image by at least 50%.

6. The system of claim 1 wherein said pre-heater system is enabled to share a fusing function with a conventional fuser station.

7. The system of claim 1 wherein said heater is a heat coil over which said air is blown by said fan.

8. The system of claim 1 wherein said pre-heater system is adapted to continuously blow heated air uniformly across a paper surface before said paper enters a conventional fusing station.

9. The system of claim 1 wherein said apertures and return tubes are arranged in a uniform pattern across an entire bottom section of said lower chamber.

10. A pre-heater system adapted to be used on a electrostatic marking apparatus at a location in said apparatus prior to a conventional fuser roll assembly or station, said system comprising in an operative arrangement a heater housing, an upper chamber, a lower chamber, open-ended return vacuum air tubes, hot air impingement apertures and at least one heater coil with an adjacent blower fan, said upper chamber and said lower chamber located within said heater housing in a contiguous arrangement, said fan adapted to blow pressurized hot air into said lower chamber, said hot air enabled to pass from said lower chamber into and through impingement apertures to a surface of an image receiving media in order to substantially dispense hot air throughout substantially an entire paper or media surface, said open-ended return vacuum air tubes enabled to subsequently suck up said heated air and return it to said upper chamber where it is fed to said blower fan for continuous circution to and from said media surface.

11. The system of claim 10 wherein said pre-heater system is located in an electrostatic marking apparatus at a position before said conventional fuser roll assembly or station.

12. The system of claim 10 wherein said return vacuum air tubes have a diameter at least two times the diameter of said apertures.

13. The system of claim 10 wherein said pre-heater system is enabled to increase a fusing speed of an image on a media by at least 50%.

14. The system of claim 10 wherein said pre-heater system is enabled to share a fusing function with a conventional fuser assembly or station.

15. The system of claim 10 wherein said pre-heater system is adapted to continuously blow heated air uniformly across a paper surface before said paper enters a conventional fusing station.

16. The system of claim 10 wherein said apertures and return tubes are arranged in a uniform pattern across an entire bottom section of said lower chamber.

17. A pre-heater system for a fusing assembly of an electrostatic marking apparatus comprising in an operative arrangement an air-tight heater housing, an upper chamber in said housing, a lower chamber coextensively below said upper chamber in said housing, a plurality of hot air impingement apertures located in a bottom section of said lower chamber, a plurality of open-ended return vacuum tubes extending from said upper chamber, through said lower chamber and even with or beyond said bottom section of said lower chamber, at least one heater coil having a blower fan adapted to blow heated air into said lower chamber and through said impingement apertures to thereby uniformly contact a surface of a paper receiving media as it travels along a travel path to a conventional fusing station, said return vacuum tubes enabled to continuously recycle said heated air to said upper chamber and said fan, said pre-heater system adapted to facilitate more efficient fusing of toner to said media, said return vacuum tubes having a diameter of from 2-10 times the diameter of said apertures, said heated air pressurized by said blower fan and enabled to uniformly contact via said apertures substantially an entire adjacent image-receiving surface and said media, an air opening is provided in a lower section of said upper chamber and said blower fan, said open-ended return vacuum tubes providing the sole air return to said upper chamber and blower fan.

* * * * *